US012796824B2

(12) United States Patent
Fried

(10) Patent No.: US 12,796,824 B2
(45) Date of Patent: Nov. 17, 2026

(54) ADJUSTABLE LEG LOAD DISTRIBUTION SYSTEMS AND METHODS

(71) Applicant: Brian Fried, Melville, NY (US)

(72) Inventor: Brian Fried, Melville, NY (US)

( * ) Notice: Subject to any disclaimer, the term of this patent is extended or adjusted under 35 U.S.C. 154(b) by 208 days.

(21) Appl. No.: 18/744,629

(22) Filed: Jun. 15, 2024

(65) Prior Publication Data

US 2025/0380812 A1 Dec. 18, 2025

(51) Int. Cl.
*A47C 16/02* (2006.01)

(52) U.S. Cl.
CPC ..... *A47C 16/025* (2013.01)

(58) Field of Classification Search
CPC ..... A47C 7/52; A47C 16/025; A47C 7/53; B60N 2/0035; B60N 2/0028; B60N 2/0274
See application file for complete search history.

(56) References Cited

U.S. PATENT DOCUMENTS 7,967,387 B2 * 6/2011 Langhorn ..... A47C 7/52 297/423.38
11,027,849 B1 * 6/2021 Chellappa ..... B64D 11/0639
11,412,859 B1 * 8/2022 Barroso ..... A47C 16/025
11,590,873 B2 * 2/2023 Migneco ..... A61B 5/6893
11,607,044 B2 * 3/2023 Brandtner ..... A47C 4/028
2023/0356019 A1 * 11/2023 Kato ..... A63B 23/03525

FOREIGN PATENT DOCUMENTS

WO WO-2014052534 A1 * 4/2014 ..... B60N 3/063

OTHER PUBLICATIONS

For (Year: 2013).*

* cited by examiner

*Primary Examiner* — David R Dunn
*Assistant Examiner* — Jessica Kathryn Thompson
(74) *Attorney, Agent, or Firm* — Mooney IP

(57) ABSTRACT

A leg elevation device includes a support structure to elevate a user's legs and an adjustment mechanism for dynamically adjusting the elevation to various desired heights. The adjustment mechanism allows the support structure to collapse to a planar configuration for storage and transport. The device is adaptable for use with different seating surfaces and includes angle straps for securing at variable angles. It features a pivoting mechanism with a reverse gear for incremental adjustments and a folding mechanism for easy transition between operational and collapsed states. The support structure can be made from materials like microfiber, synthetic leather, or nylon, and is designed to support up to 250 pounds. An elevation adjustment feature may be motorized, operating on a power source such as a 120-volt transformer system or a rechargeable battery.

20 Claims, 8 Drawing Sheets

ADJUSTABLE LEG LOAD DISTRIBUTION SYSTEMS AND METHODS

BACKGROUND

The invention relates to a leg elevation device designed to provide comfort and enhance circulation in users' legs, featuring an adjustable support structure for various elevation heights, a collapsible design for easy storage, and an ergonomic angle adjustment for user preference. It includes a pivoting mechanism with a reverse gear for precise elevation control, materials for comfort and durability, and a reinforced frame to support different body weights. The device may also have motorized elevation adjustments and can be part of a system with a microcontroller, interaction interface, software for remote adjustments, health monitoring sensors, and compatibility with VR/AR technologies for therapeutic purposes.

SUMMARY OF THE INVENTION

In general, in a first embodiment, the techniques described herein relate to a leg elevation device, including: a support structure configured to elevate a user's legs; and an adjustment mechanism integrated with the support structure for adjusting the elevation of the user's legs.

In other embodiments, the techniques described herein relate to a method for elevating a user's legs, including: providing a leg elevation device that includes a support structure and an adjustment mechanism; and engaging the adjustment mechanism to modify the elevation of the support structure, thereby elevating the user's legs.

In yet other embodiments, the techniques described herein relate to a leg elevation system for enhancing circulation in users' legs, including: a leg elevation device featuring a support structure and an adjustment control system for modulating the elevation of the support structure; and an interaction interface for receiving commands to adjust the elevation, facilitating a user-centric approach.

The above advantages and features are of representative embodiments only, and are presented only to assist in understanding the invention. It should be understood that they are not to be considered limitations on the invention as defined by the claims. Additional features and advantages of embodiments of the invention will become apparent in the following description, from the drawings, and from the claims.

DETAILED DESCRIPTION

Figure 1:
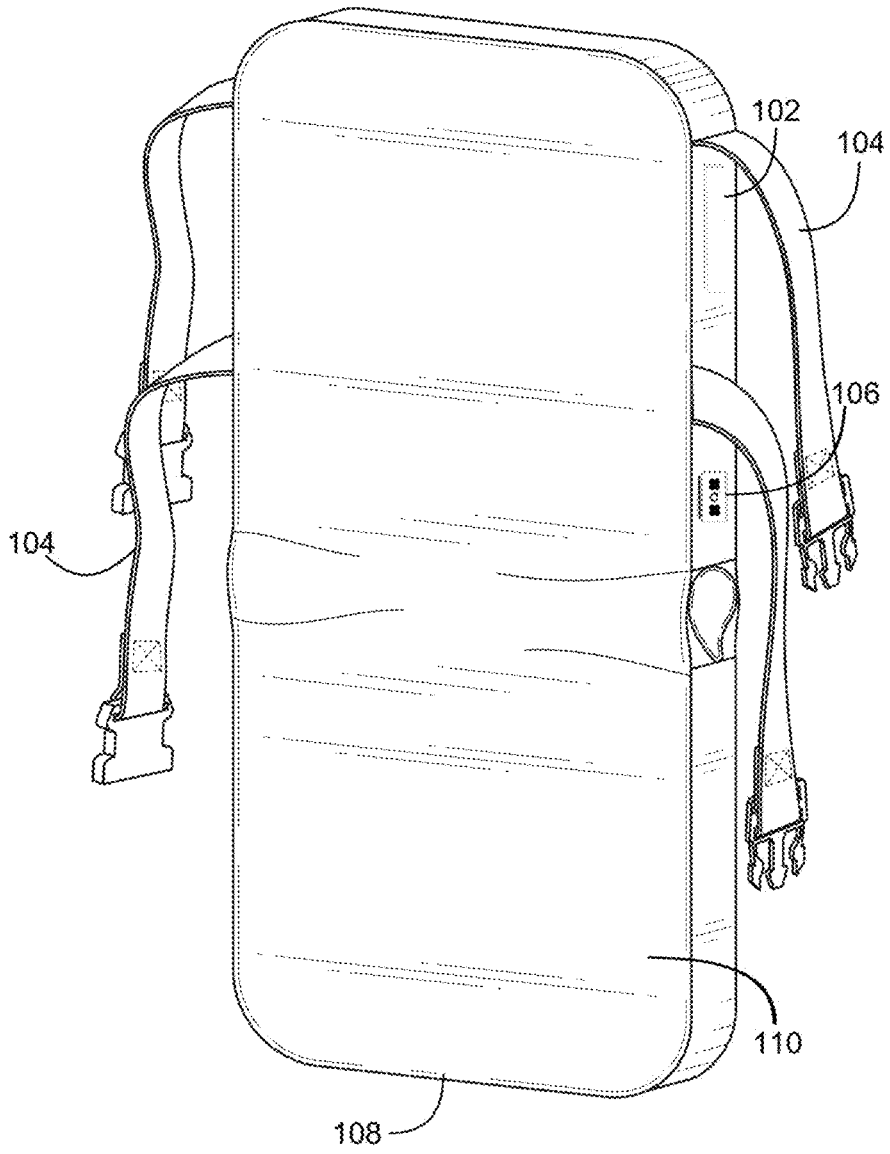
FIG. 1 illustrates an example embodiment of an adjustable leg load distribution system.

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Clause 1. A leg elevation device which is detached from any seatback, comprising: a support structure configured to elevate a user's legs; and an adjustment mechanism integrated with the support structure for adjusting the elevation of the user's legs.

Clause 2. The leg elevation device of clause 1, wherein the adjustment mechanism enables the support structure to collapse to a substantially planar configuration for convenient storage.

Clause 3. The leg elevation device of clause 2, adaptable for use with a variety of seating surfaces including, but not limited to, office chairs, couches, and dining chairs, demonstrating versatility.

Clause 4. The leg elevation device of clause 3, further comprising angle straps attached to the support structure for securing the leg elevation device at variable angles relative to a seating surface, accommodating various user preferences.

Clause 5. The leg elevation device of clause 1, wherein the adjustment mechanism comprises a pivoting mechanism including a reverse gear for facilitating incremental adjustments of an elevation of the support structure.

Clause 6. The leg elevation device of clause 5, further comprising a folding mechanism coupled to the support structure, which permits the device to alternate between an operational state and a collapsed state.

Clause 7. The leg elevation device of clause 6, wherein the pivoting mechanism is characterized by an incremental adjustment feature enabling sequential elevation adjustments of the support structure.

Clause 8. The leg elevation device of clause 7, wherein the support structure is fabricated from a material selected from the group consisting of microfiber, synthetic leather, and nylon to provide comfort and durability.

Clause 9. The leg elevation device of clause 7, structured to achieve at least five incremental elevation positions before reverting to a base position, ensuring a range of comfort options.

Clause 10. The leg elevation device of clause 9, wherein the support structure incorporates a reinforced frame designed to support a user weight of up to 250 pounds, offering robust usability.

Clause 11. The leg elevation device of clause 10, wherein the pivoting mechanism comprises an elevation adjustment feature operable through motorized means for user ease.

Clause 12. The leg elevation device of clause 11, wherein the motorized elevation adjustment feature operates on a power source selected from a 120-volt transformer system or a rechargeable battery, ensuring versatile power options.

Clause 13. A method for elevating a user's legs, comprising: providing a leg elevation device that includes a support structure and an adjustment mechanism; and engaging the adjustment mechanism to modify the elevation of the support structure, thereby elevating the user's legs.

Clause 14. The method of clause 13, wherein engaging the adjustment mechanism includes activating a pivoting mechanism fitted with a reverse gear, enhancing a user's control over leg elevation.

Clause 15. A leg elevation system for enhancing circulation in users' legs, comprising: a leg elevation device featuring a support structure and an adjustment control system for modulating the elevation of the support structure; and an interaction interface for receiving commands to adjust the elevation, facilitating a user-centric approach.

Clause 16. The leg elevation system of clause 15, wherein the adjustment control system includes a microcontroller, and the interaction interface is capable of receiving wireless signal or voice commands, offering hands-free operation.

Clause 17. The leg elevation system of clause 15, further comprising a software framework that enables remote configuration adjustments via a mobile application, adding a layer of convenience for users.

Clause 18. The leg elevation system of clause 15, further integrating health monitoring sensors for gathering data on user interaction, aiming for customized comfort adjustments.

Clause 19. The leg elevation system of clause 15, wherein the adjustment control system employs usage logs and a memory storage device to tailor elevation settings based on gathered usage data, optimizing user comfort and therapeutic benefit.

Clause 20. The leg elevation system of clause 15, designed for compatibility with virtual reality or augmented reality technologies, to provide guided therapeutic exercises, extending usability of the device beyond basic elevation.

FIG. 1 provides a perspective or isometric view of the main embodiment of the invention, designated as an "Adjustable Leg Load Distribution System." This figure is essential to illustrate the configuration and relative positioning of various components that contribute to the functionality and usability of the device.

Side strap handles 102 are depicted in the figure, and are essential for enhancing the portability and ease of handling of the device. These handles may be constructed from a range of materials including microfiber, pleather, or nylon, providing durability and user comfort.

The device incorporates four strap attachment locations 104 which enable the device to be securely fastened to a chair or other seating surfaces. The straps, which may be Velcro, belt buckles, or click straps, include two pairs; one pair situated at the edge of the seat to wrap around the back of the chair, and the other pair designed to secure under the seating surface, thus ensuring stability and safety during use.

An on/off switch and input configuration device 106 serves dual functions as both an on/off switch and an input configuration unit. This component may support Bluetooth connectivity for wireless operation or serve as a connection point for a wired controller. This controller could provide various controls and memory functions to tailor the device settings to the user's needs.

A metal frame 108 outlines the perimeter of the top face of the seat, providing structural support, rigidity, and enhanced strength to the leg load distribution system. The frame is crafted from metal, chosen for its durability and load-bearing capacity.

The seating surface, indicated by 110, can be made from any of the previously mentioned materials such as pleather or nylon. These materials are selected to ensure comfort, ease of maintenance, and durability, while also fitting the aesthetic and functional requirements of the device.

The strategic placement and thoughtful design of these components ensure that the leg elevation device not only effectively distributes load and elevates the user's legs but is also convenient and adaptable to various environments and user preferences. This detailed visual representation aids in understanding the construction and operational context of the device as claimed in the patent application.

The support structure of the leg elevation device, while exemplified in initial embodiments as being composed of materials such as pleather, nylon, and microfiber, is alternatively envisioned to be fabricated from a variety of other suitable materials. These may include, but are not limited to, polyester, canvas, advanced polymer composites, or any combinations thereof, each selected for their specific properties such as durability, comfort, and environmental resistance. Furthermore, the metal frame may be constructed from various metals such as aluminum, stainless steel, or lightweight alloys like titanium, or even from high-strength composite materials enhanced with carbon fiber or fiberglass, offering structural integrity while minimizing the overall weight of the device.

In certain embodiments, the seating surface of the device may incorporate thermal elements capable of heating or cooling the seating area. This feature can provide additional comfort and therapeutic benefits to the user, aiding in muscle relaxation and reduced inflammation. Additionally, integrated massaging elements may be included, which can be activated through manual controls or automatically via the control system, to enhance circulation and user comfort during prolonged periods of sitting.

The design of the leg elevation device allows for modular and interchangeable components, whereby elements such as the strap handles and strap attachment mechanisms can be customized or replaced independently. This modularity facilitates maintenance and personalization of the device according to individual user needs. Interchangeable seat tops may be offered in various ergonomic designs or cushioning levels, easily swapped out to suit different user preferences or specific health-related needs.

The device is designed to accommodate a range of body types and seating situations by allowing adjustments to the size and shape of the seat. Variations may include wider versions for increased stability or elongated versions for full-leg support. The strap attachment locations are also adjustable, enabling secure attachment to a wide array of chairs and seating environments, including specialized furniture such as wheelchairs and automotive seats, thereby ensuring versatility across different living and working spaces.

The control system of the leg elevation device is capable of supporting various connectivity options including Bluetooth, Wi-Fi, NFC, and compatibility with smart home systems or IoT devices. This allows for seamless integration into modern home and office environments. Furthermore, the inclusion of a microcontroller enables the development of AI-driven features that automatically adjust the device settings based on learned user preferences, optimizing comfort and therapeutic effectiveness without manual intervention.

Enhanced safety features are incorporated into the design, including automatic locking mechanisms that engage when the device is adjusted to a desired position, preventing unintended movement. The device is also designed to meet international safety and quality standards, ensuring that it can be safely used in various global markets and in diverse regulatory environments.

Figure 2A:
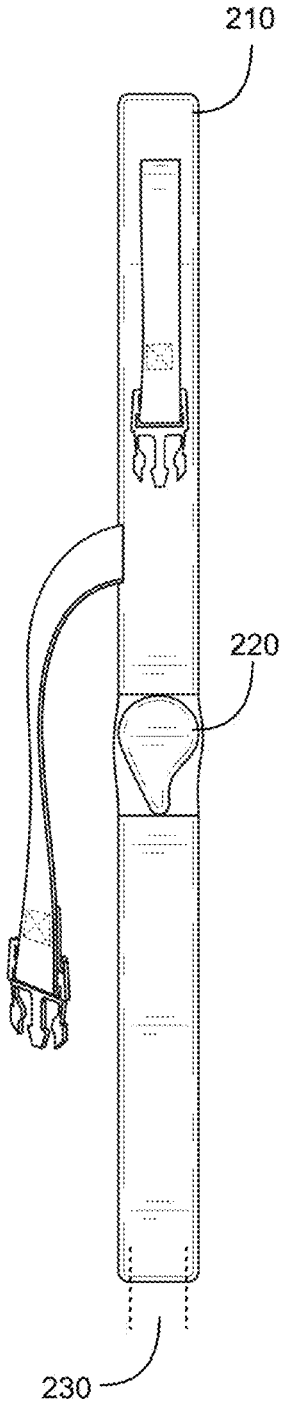
FIG. 2A illustrates an embodiment of an elongated configuration with support structures.

FIG. 2A presents a side view of an embodiment of the leg elevation device, featuring a metal support frame 210. This frame envelops the perimeter, ensuring the structural integrity and support of the seating system's panels, which are interlinked via a pivot joint 220. This connection facilitates adjustable configurations of the panels to suit user preferences for comfort or specific use cases. Additionally, the design incorporates a pullout extension slot 230, designed to extend the seating system's length to accommodate users of varying heights. This extension mechanism can be implemented using various technologies, including but not limited to telescopic slides, fold-out extensions, or configurable segments, providing flexibility and customization in use.

Figure 2B:
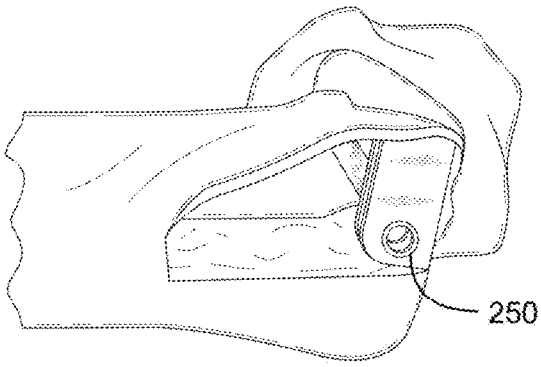
FIG. 2B illustrates an example embodiment of internal support structures.

FIG. 2B illustrates a see-through view, as a partial cross-sectional view through external cushioning and fabric, of the internal support structures. Support structure 250 illustrates how a pivot joint may be produced in one of the very simplest embodiments, to connect the two major panels of the leg load distribution system together. It shows an optional placement for a ball bearing if the ratchet joint is not placed at the intersection of the two major panels. The two major panels are the first panel which is sat on during use and the second panel which, during use, has legs loaded on.

In certain aspects, the leg load distribution system employs fundamental structural and mechanical engineering principles to enhance stability and functional efficiency. The system comprises two panels that utilize leverage to distribute the weight of the user's legs evenly, while also providing a stable platform for leg elevation. The panels operate on a lever mechanism that amplifies the input force, allowing effortless elevation of the user's legs with minimal manual effort or motorized input.

In some aspects, the panels are strategically designed with pivot points located in such a manner that they maximize the mechanical advantage. This setup ensures that when a user activates the mechanism—either manually through a ratcheting system or via an electric motor—the force applied is efficiently converted into movement, thereby elevating the legs to the desired position. The use of high-grade materials such as reinforced polymers or lightweight metals in the construction of these panels not only ensures durability but also contributes to the overall stability of the system by reducing the risk of flexing or bending under load.

In several aspects, the structural integrity and operational stability of the leg load distribution system are further enhanced by the weight of the user seated on the system. As suggested by the inventor, the weight of the user's body on the seat cushion plays a crucial role in stabilizing the device during operation. This is because the downward force exerted by the user's body weight helps anchor the seat, providing a counterbalance to the upward force applied by the leg panels as they elevate.

In other aspects, this counterbalancing effect is pivotal, especially in manual operation modes where mechanical feedback and resistance can vary. By leveraging the natural weight of the user, the system minimizes the likelihood of tipping or unwanted movement, thus maintaining a steady and secure elevation of the legs. Additionally, this principle allows for the design of the system to be more compact and less reliant on heavy external stabilizing structures, which can be beneficial in terms of portability and ease of use.

In various aspects, the engineering behind this system not only optimizes functionality and user comfort but also enhances safety. By integrating the user's body weight as a stabilizing factor, the system ensures that the leg elevation process is smooth and controlled, avoiding abrupt movements that could potentially lead to discomfort or injury. This thoughtful integration of mechanical principles and user-centric design underscores the innovative approach to improving mobility and comfort for users, especially those in rehabilitation or requiring enhanced leg support.

Figure 2C:
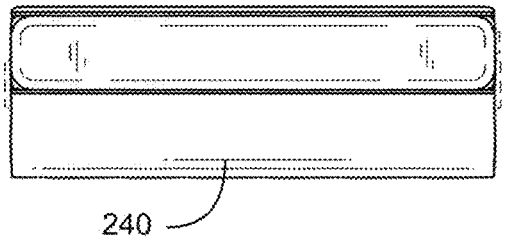
FIG. 2C illustrates an example embodiment of a folded configuration with support structures.

FIG. 2C illustrates another side view of the leg elevation device, specifically highlighting its folded configuration 240. This configuration is optimized for compact storage and ease of transport, making the device highly suitable for various environments, such as home, outdoor, or public spaces. The folding mechanism is designed to be intuitive and user-friendly, allowing the device to transition smoothly between operational and storage states with minimal effort. This feature is particularly beneficial for users requiring a portable solution for leg elevation, ensuring the device can be easily carried to different locations as needed. The design accommodates various mechanisms for folding, including but not limited to collapsible joints, retractable components, or foldable materials, each contributing to the device's overall portability and convenience.

In order to expand the scope and enhance the utility of the leg elevation device, several variations in materials, structural designs, and manufacturing processes are considered. Broadening the range of materials used in the device can ensure the flexibility to meet various user needs and cost targets. The metal support frame, specified in previous embodiments, could be constructed from diverse metals and alloys, such as aluminum for its lightweight properties, steel for its strength, or even titanium for a balance of weight and durability. Additionally, the seating panels could incorporate materials like high-density foam for enhanced comfort, durable polymeric substances for waterproof capabilities, and advanced composites or hybrids for superior durability and aesthetic appeal. Moreover, surface coatings such as anti-corrosive treatments, UV protective layers, or antimicrobial coatings can be applied to enhance the longevity and hygiene of the device.

The structural and mechanical design of the leg elevation device also offers several avenues for variation to accommodate different usage scenarios and preferences. For instance, the pivot joint 220 might be implemented using alternative designs such as a ball and socket joint, which allows for smooth multidirectional movement, or a hinge with adjustable tension that can be tightened or loosened as per user preference. Additionally, the extension mechanism denoted by pullout extension slot 230 could employ telescopic slides that offer precise extension lengths, fold-out extensions for increased surface area, or inflatable sections that can adjust dynamically to the user's body dimensions. The adjustability of the device may be further enhanced by integrating electronic controls or manual adjustment systems capable of fine-tuning the extension degree and seating angle, potentially augmented by sensors that adapt the configuration based on real-time feedback regarding the user's weight or seated posture.

From a manufacturing standpoint, adopting a modular design can significantly streamline both the production and maintenance processes. This modularity enables easy assembly and disassembly, facilitating both initial manufacture and any subsequent repairs or part replacements. Emphasizing eco-friendly manufacturing practices by utilizing recycled materials or renewable energy sources can also diminish the environmental impact of production. Additionally, the adoption of scalable manufacturing techniques, such as injection molding for plastic components or CNC machining for metal parts, ensures that the device can be efficiently produced in varying volumes, from small-scale bespoke orders to large-scale production runs.

To further augment the functionality of the leg elevation device, incorporating advanced features such as integrated health monitoring and smart device compatibility could offer significant added value. Biometric sensors embedded within the seating surface could track health metrics like heart rate or blood circulation, particularly beneficial for users recovering from surgery or those with specific health conditions. Moreover, ensuring compatibility with contemporary smart home ecosystems could allow for adjustments to be made via mobile apps or voice commands through popular digital assistants, enhancing the user-centric nature of the device. An enhanced user interface could include options such as touch screens or haptic controls, providing intuitive and accessible means for users to modify device settings according to their specific needs.

By considering these diverse materials, designs, and functionalities, the patent application can robustly cover a wide array of embodiments, thereby providing broad protection and increasing the commercial appeal of the leg elevation device. This comprehensive approach ensures substantial coverage against potential competitors while catering to a broad market segment, ultimately enhancing both the enforceability and the market value of the patent.

Figure 3:
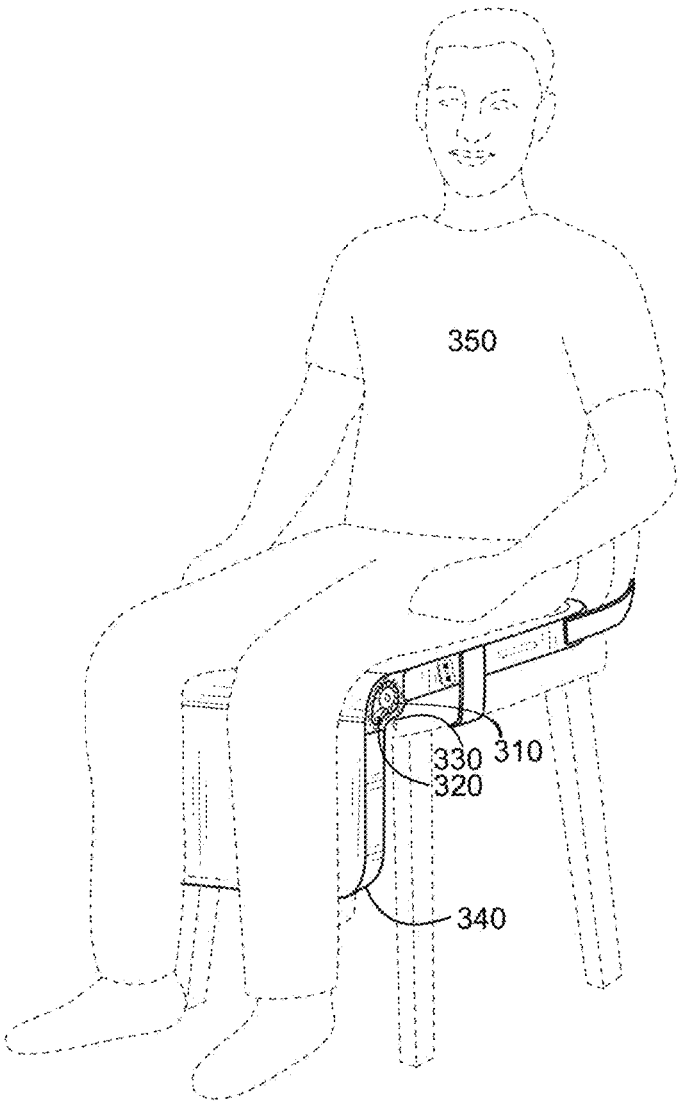
FIG. 3 illustrates an example released leg load configuration of a reverse pawl and ratchet wheel.

FIG. 3 illustrates a leg load distribution system and method that may be deployed by a user seated on the leg load distribution system when it is placed on a sitting area. This system is integral to the leg elevation device, offering effective support and distribution of the user's weight across the device to maintain balance and comfort during use. The following description elaborates on each component depicted in FIG. 3 and explains their collective function in the operation of the leg elevation device.

Ratchet wheel 310 serves as a crucial component in a pivot joint system. It may be designed to be sturdy and simple, serving as a primary structural component that may interface with various structural elements of the leg elevation device. The ratchet wheel allows for adjustable positioning of the leg load panel, supporting various elevation angles to accommodate user preferences.

The ratchet wheel 310 may be constructed from materials such as hardened steel, reinforced polymers, or other suitable materials engineered to withstand mechanical stresses while maintaining precise engagement.

Pawl 320 functions to engage with and lock against the teeth of the ratchet wheel 310. This locking action prevents the backward movement of the ratchet wheel, thereby maintaining the desired position of the leg load panel. The pawl 320 may be loaded by various means, such as a spring or an alternative biasing mechanism, to ensure a firm and secure engagement with the ratchet wheel.

The design of the pawl may complement the tooth profile of the ratchet wheel to ensure minimal wear and maximum reliability. Various durable and fatigue-resistant materials may be used for the pawl.

Release 330 is depicted as an arrow indicating the vertical movement necessary to disengage the pawl 320 from the ratchet wheel 310. This action may be essential for adjusting the elevation of the leg load panel or collapsing the device for storage.

The release mechanism may be manually operated through a lever, button, or could be part of an automated system that responds to user commands.

In the released position 340, the leg load distribution system is shown with the leg load panel positioned vertically downwards at a right or nearly right-angle (such as a slightly obtuse angle) from the butt seat panel. This configuration represents a possible fully lowered position, ideal for idle placement on a seat or initial setup before use and leg lifting/loading.

The transition to and from the released position may be facilitated by the coordinated action of the ratchet wheel 310, pawl 320, and the release 330 mechanism, allowing smooth and controlled movement of the leg load panel.

User 350 engages with the device by sitting on the butt seat panel. The user's weight may apply leverage, enabling stable positioning of the leg load panel without risk of tipping. This weight distribution is critical for the effective function of the leg load distribution system, ensuring comfort and safety during use.

The design of the seat and leg load panels may consider ergonomic factors to maximize comfort and support for the user, promoting prolonged use without discomfort.

In one embodiment, the leg load (weight-bearing) panel could be elevated through a spring-loaded mechanism. This mechanism would involve a set of robust compression springs positioned beneath the leg load panel. As the release mechanism is activated, the stored energy in the springs could automatically push the panel upward, transitioning it from a released position to a linear configuration. This automatic adjustment would allow for a user-friendly, hands-free operation, especially beneficial for users with limited mobility.

In other aspects, the user may manually lift the leg load panel using handles or grips integrated into the sides of the panel. This method would provide tactile feedback and physical control over the movement, catering to users who prefer manual adjustments for setting the precise angle of elevation suited to their comfort.

Further, more advanced aspects may incorporate an electric motor to raise the leg load panel. Two types of motors could be utilized: a stepper motor or a servo motor, both of which are electrically powered. A stepper motor could be employed for its precision in controlling the elevation angle. This motor would incrementally move the leg load panel, allowing for precise adjustments and the ability to hold the panel steadily at any desired height without additional support. Alternatively, a servo motor could be used for its speed and torque capabilities. This motor would be particularly useful in quickly adjusting the leg load panel to the desired height and maintaining that position with high stability, which is advantageous during prolonged usage.

In still other aspects, the leg load distribution system may provide for independent elevation of each leg via a bisected leg load panel, a higher elevation design. In the bisected leg load panel, rectangular sections of the leg load/lift panel are separated for general use. The leg load panel may be designed to split into two independent sections, each capable of being raised or lowered separately. This design is beneficial for users recovering from surgery on one leg, as it allows for the elevation of just one leg at a time. Each half of the panel could be operated by its own control mechanism, possibly linked to a separate motor (stepper or servo) or manual lever.

For a more specialized approach, the device adopts mechanisms similar to those found in leg chairs which lift legs far up out of the way such as those used at specialized doctors for recovering from a leg, knee, ankle, or foot-related injury and propping it up high in bed, or those used at a gynecologist to comfortable a leg. Each half of the bisected leg load panel could be equipped with curved supports that conform to the shape of a user's calves or thighs. These supports could cradle each leg individually, providing comfortable and secure elevation. The adjustment mechanism for these supports could involve fixed supports ensuring higher elevation, hydraulic or spring systems for smooth, continuous movement, or motor-driven systems for precise control over the elevation angle.

Figure 4:
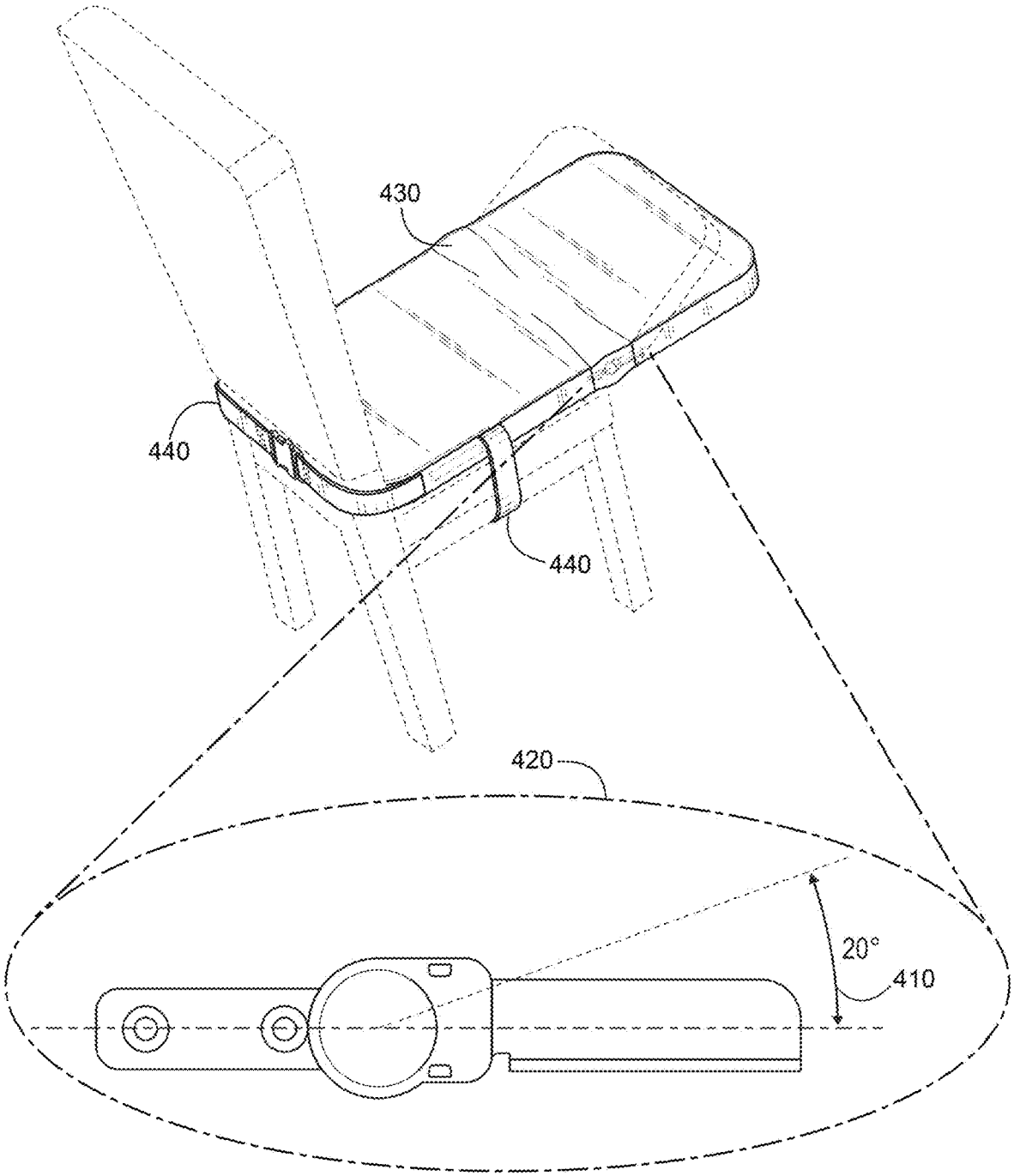
FIG. 4 illustrates an example embodiment of an adjustable leg load ratchet release function.

Turning to FIG. 4, illustrated is the leg load distribution system in its fully raised, straight position. This position of the leg load panel in relation to the seating panel is designated as linear configuration 430. This configuration is crucial for providing optimal leg support and enhancing user comfort, particularly for users requiring elevated leg positions for extended periods, such as those recovering from surgery or with circulation issues.

In some aspects, the leg load panel may be designed with modular sections, allowing users to adjust the length of the support according to their height and specific needs. Each module could be added or removed easily and locked into place using a similar ratchet mechanism. Similarly, to accommodate different chair sizes and designs, the leg load panel could feature sliding mechanisms on either side, enabling the panel to expand or contract in width. This adaptation ensures that the device can be securely fitted to a wide range of chair types, from narrow office chairs to wider seats and couch cushions.

Further illustrated is a strap engagement 440 which is a mechanism. The depiction shows straps wrapped around the bottom of a chair to provide fixed immobilization. This setup offers increased stability and ensures that the device remains securely positioned during use.

In other aspects of the strap engagement features and components, instead of fixed straps, a hook-and-loop system could be implemented for easier adjustment and quick release, allowing for a more user-friendly setup and removal process. Incorporating magnetic attachments and attachment points in some aspects may provide a secure hold while also allowing for rapid deployment and removal without the need to adjust straps manually.

In ratchet hinge embodiment 420, we see an example of a ratchet hinge assembly for the pivot connection joint between the two major panels of the adjustable leg load distribution system.

The ratchet hinge 450, showcased in the zoom bubble, provides a sophisticated mechanism enabling adjustable pivot angles. This hinge includes metal extremities that secure into the frame of each respective panel, enhancing the robustness and durability of the device.

There are alternative embodiments of this ratchet hinge 450. For example, implementing an electronic control system within the hinge could allow for automatic adjustments based on pre-set user preferences or real-time feedback from onboard sensors measuring leg position, pressure, or angle.

In other aspects, a hydraulic or pneumatic assist may be implemented. To reduce the physical effort required to adjust the leg load panel, a hydraulic or pneumatic system could be incorporated into the hinge, providing smooth and effortless positioning.

Release Range 410 details a feature of a pivot range threshold of approximately negative twenty degrees, at which point, when this angle is surpassed, a user is activating the release mode, enabling the leg load panel to return to the starting position near a ninety-degree right angle (at least 70 degrees). This functionality is essential for safety and usability, allowing users to quickly revert the panel to its initial position.

Adjustable threshold settings may be implemented in some aspects. Allowing users to customize the pivot range threshold may cater to different comfort levels and physical conditions. A simple interface on the device, a handheld wired controller interface, or an accompanying app enables this adjustability.

Sensor-based release mechanisms may also be integrated in some aspects. Integrating sensors that detect excessive weight or unusual movement patterns could automatically trigger the release mechanism, ensuring user safety by preventing unwanted movements or positions. For example, to prevent breakage, the release may be triggered in excessive pressure circumstances, or, to prevent wasted energy, the release may engage after excessive time periods of motorized elevation when such duration is unnecessary.

Figure 5:
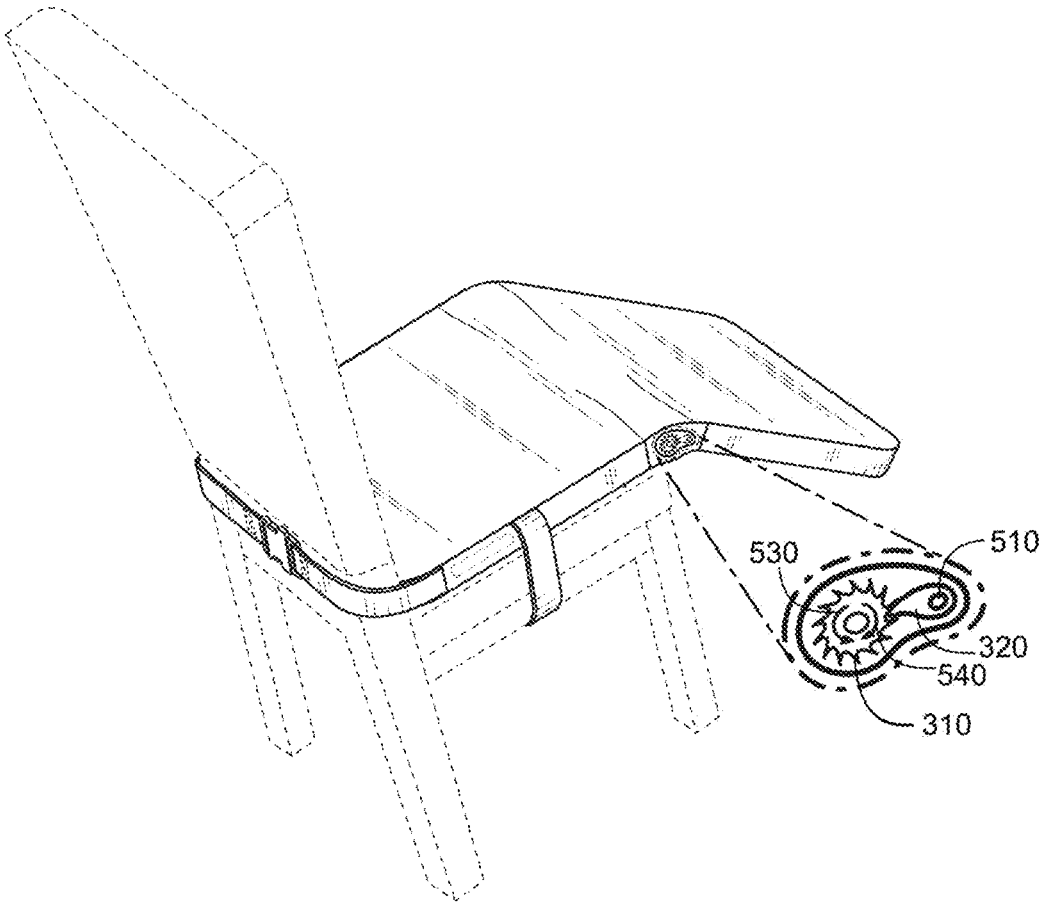
FIG. 5 illustrates an example embodiment of a locked leg load distribution system.

FIG. 5 illustrates an enhanced reverse ratchet gear mechanism internal to the pivot joint 510. A pivot joint 510 supporting member securely holds the pawl 320, which features a teardrop shape allowing it to engage effectively with the teeth of the sawtooth-blade-like ratchet wheel 310. In some aspects, the pawl 320 may drop between the teeth of the ratchet wheel 310 to facilitate controlled movement. The mechanism includes a locked direction 540 and an unlocked direction 530, allowing for directional control of the movement.

In some aspects, the device may incorporate a dual-pawl system where a second pawl is positioned opposite the first on the ratchet wheel 310. This configuration may distribute the load more evenly across the mechanism, potentially enhancing the stability and durability of the device.

Furthermore, the pivot joint 510 may be part of a modular assembly that can be easily installed, replaced, or upgraded within the support structure of the leg elevation device. This modular approach may allow for rapid customization and maintenance without requiring complete device disassembly.

An electronically controlled actuator may also be integrated with the ratchet mechanism to automatically adjust the position of the pawl 320 based on inputs from a control system. This system may be programmed to adjust the leg elevation at predetermined intervals or in response to sensor data, providing adaptive comfort adjustments for the user.

In some aspects, the ratchet wheel 310 may feature adaptive tooth spacing, which allows for adjustments in the granularity of the elevation settings. Users may select from various ratchet wheels with different tooth configurations to achieve finer or coarser elevation adjustments as per their specific needs.

Material innovations may also be explored, where the ratchet wheel 310 and pawl 320 are constructed from advanced polymers or composite materials. These materials may offer reduced weight, enhanced durability, and resistance to environmental factors, contributing to the overall performance and longevity of the leg elevation device.

Each of these aspects may be combined in various configurations to tailor the device to meet a wide range of user preferences and medical requirements, providing a versatile and user-centric solution for leg elevation.

In the implementation of leg elevation device aspects, utilizing ratchet mechanisms for adjusting and maintaining elevation, there are various configurations of springs that may be employed to customize the functionality and reliability of the system. The spring used in conjunction with the pawl plays a critical role in controlling the engagement and disengagement with the ratchet wheel, thereby ensuring the device operates smoothly and efficiently.

One effective configuration is the use of a torsional spring. This type of spring is designed to apply a rotational force, or torque, and is particularly useful in scenarios where the pawl needs to be lifted or rotated away from the ratchet wheel to allow for adjustment or release of the engaged position. The torsional spring can be configured to exert force directly on the pawl, enabling it to engage securely with the ratchet teeth when elevation adjustment is not being made, and to easily disengage when the user needs to alter the leg position or fold the device for storage.

Alternatively, a compression or extension spring configuration can be used, which exerts a linear force. This setup is beneficial for pushing or pulling the pawl into or out of engagement with the ratchet wheel. In a compression setup, the spring compresses in response to force applied during the adjustment, allowing the pawl to move into a locking position. When the force is released, the spring expands, helping to disengage the pawl from the ratchet wheel. In an extension setup, the spring works by stretching, providing the necessary force to engage the pawl with the ratchet wheel and retracting to facilitate its release.

Both torsional and linear (compression or extension) springs offer distinct advantages depending on the specific requirements of the leg elevation device, including the desired smoothness of operation, load handling capabilities, and space constraints within the device design. Each type of spring configuration allows for precise control over the pawl and ratchet mechanism, ensuring that users can easily adjust the elevation of their legs to the desired height and maintain stability once the preferred position is achieved.

Varying the spring configuration affects the ease and reliability of the adjustment mechanism and also impacts the overall durability and maintenance requirements of the device. By incorporating different spring types and configurations, the design can accommodate various user needs and preferences.

Figure 6:
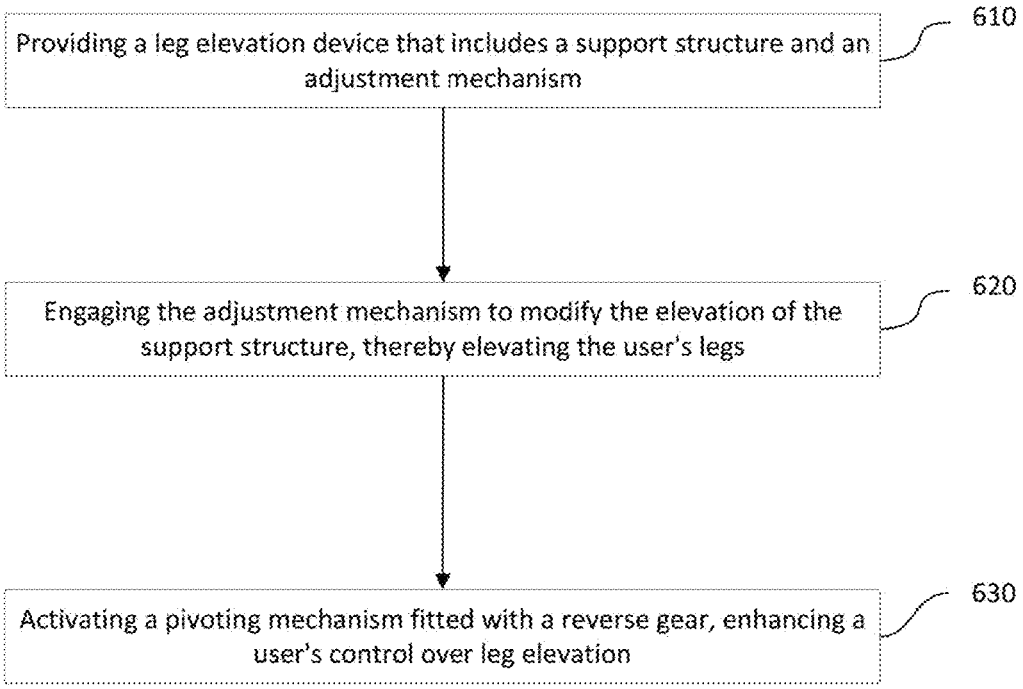
FIG. 6 illustrates a simplified example method of using an adjustable leg load distribution system.

Turning to FIG. 6, step 610 is providing a leg elevation device that includes a support structure and an adjustment mechanism. In certain aspects, the leg elevation device may include a support structure incorporating a multi-layered cushioning system. This system could comprise a lower layer constructed from high-density foam for enhanced structural support, and/or an upper layer composed of viscoelastic foam, commonly known as memory foam, to deliver elevated comfort levels. This dual-layer configuration not only seeks to enrich the user experience by providing supreme comfort but also aims to preserve the shape and durability of the device through extended use.

Step 620 is engaging the adjustment mechanism to modify the elevation of the support structure, thereby elevating the user's legs. Additionally, in some embodiments, the adjustment mechanism might be implemented utilizing hydraulic or pneumatic systems instead of traditional mechanical gears. These systems may offer smoother and quieter operation, which can be especially advantageous in clinical environments where minimizing noise is essential. The hydraulic or pneumatic systems could be manually operated through a hand pump, or they might be automated with an electric pump that adjusts the elevation in response to user inputs or pre-set configurations.

Step 630 is activating a pivoting mechanism fitted with a reverse gear, enhancing a user's control over leg elevation. This reverse gear arrangement is an uncommon configuration which enables the weight of the leg load-bearing panel to be in locked direction 540 and unlocked in direction 530 as shown in FIG. 5 while still providing for 270 degrees of movement in each direction, depending on the release, going from fully idle position on a seat to fully folded, and back. Further, in some embodiments, the pivoting mechanism equipped with a reverse gear may be enhanced with electronic sensors that detect the elevation angle and automatically adjust it to align with medically recommended positions. These sensors could be integrated with a digital display providing real-time feedback to the user about the elevation angle, thus facilitating precise adjustments tailored to individual therapeutic requirements.

In another implementation, the leg elevation device may feature modular components that enable users to customize the design according to their specific preferences. For instance, the support structure may be designed to accommodate optional attachments such as heated pads or cooling gels, which can be inserted into designated compartments within the cushion layers. This modularity allows the device to offer not just elevation but also additional therapeutic benefits such as heat or cooling treatments, potentially beneficial for users suffering from conditions like arthritis or sports-related injuries.

To further enhance user interaction with the device, the adjustment mechanism may be integrated with a mobile application that enables remote control functionalities. This application could provide a user-friendly interface to adjust the elevation, monitor session durations, and even send reminders to change positions periodically, thus promoting better ergonomic practices. The app may also feature functionality to store personalized elevation settings for multiple users, making the device particularly suitable for environments shared by several individuals, such as family homes or rehabilitation facilities.

Each of these embodiments may utilize a range of materials designed to enhance the device's functionality and aesthetic appeal. For example, the support structure might be constructed from lightweight aluminum for easy adjustment and mobility, while the exterior coverings could be crafted from sustainable materials such as bamboo fiber or recycled polyester, appealing to environmentally conscious consumers. These materials not only promote sustainability but also provide durability and ease of cleaning, which are critical factors for both personal and clinical usage.

Figure 7:
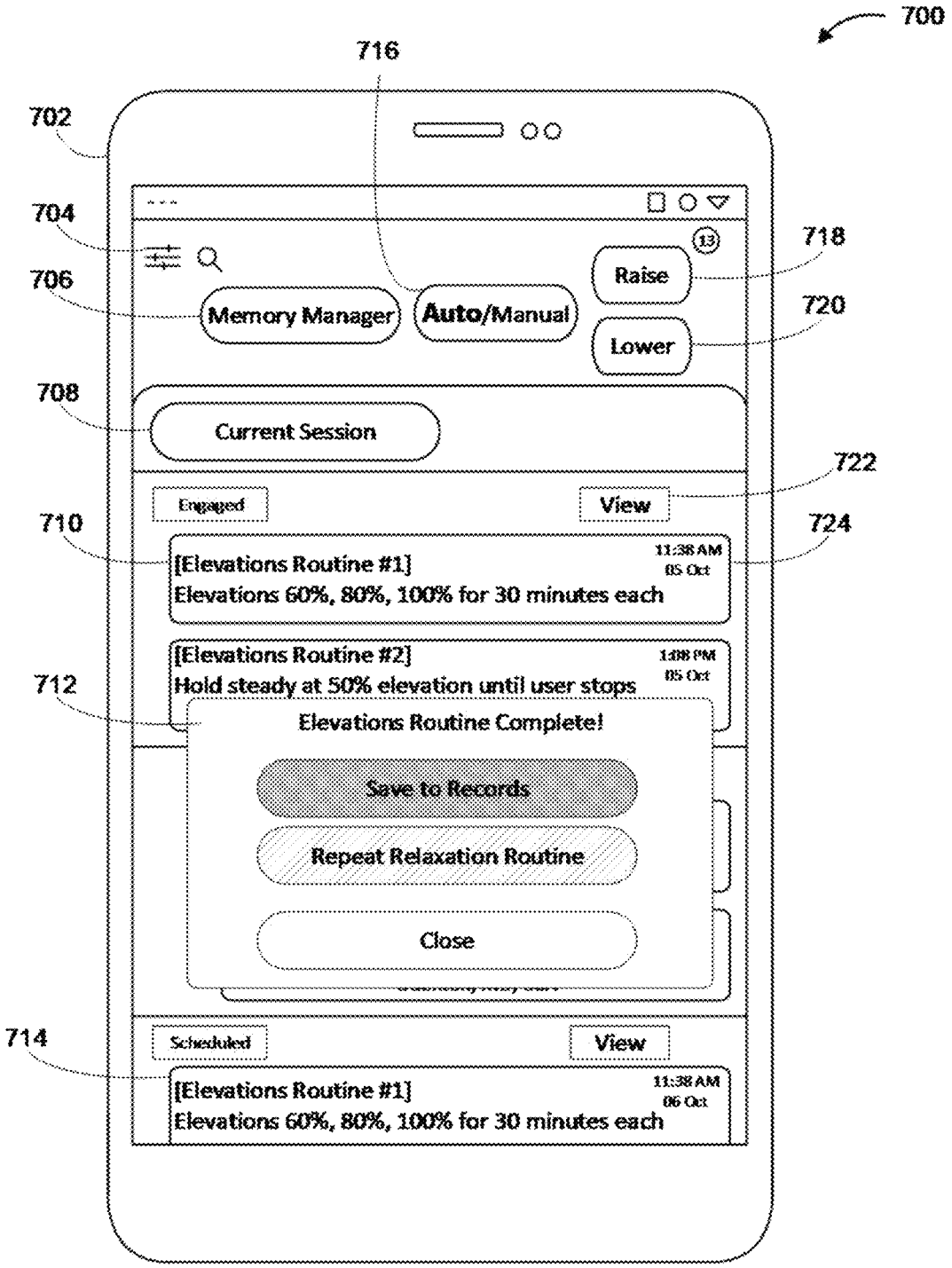
FIG. 7 illustrates an example embodiment of an input configuration device.

FIG. 7 illustrates an input configuration device 700. In certain aspects, FIG. 7 illustrates the user interface of input configuration device 700, exemplifying a multifunctional control system designed for an adjustable leg load distribution system. The input configuration device 700 may adapt across various platforms, including, but not limited to, cell phones, laptops, tablets, and dedicated devices specifically configured to interact with leg elevation systems. This device may be embodied by a pre-owned personal device owned by the user, or a standalone dedicated hardware controller that is built-in, wirelessly paired with, or otherwise tethered to the leg load distribution system, serving as a versatile interface for managing the system.

In some aspects, integral to the input configuration device 700 is a hardware enclosure 702. This enclosure 702 may not only enhance the device's portability but also serves as a secure housing, allowing users to interface directly with the leg load distribution system. Furthermore, the enclosure 702 may facilitate the display of real-time statistics related to relaxation and usage data, significantly augmenting user interaction with the elevated leg system. The housing of the input configuration device 700 is often crafted from robust polymer composites, offering a balance between lightweight design and durability. For enhanced protection, the device casing may incorporate shock-absorbent materials and be compliant with IP68 standards for water and dust resistance.

In various aspects, the user interface includes a menu 704, serving as a navigational tool to access various functionalities of the application. This menu 704 may enable users to analyze data, view historical usage, transfer session data, participate in collaborative communications, and log recovery activities, crucial for users requiring detailed analyses of their leg elevation routines. The software framework on the input configuration device 700 may utilize a combination of native and web applications developed in programming languages such as JavaScript and related frameworks to ensure cross-platform compatibility. Alternative embodiments may be configured with highly affordable chipsets which use relatively low-level programming to operate and control motor signals without a visual screen interface.

In several aspects, a session header 706, displayed as "Memory Manager," indicates the active management module within the device. It may offer users options to manage data concerning leg load distribution usage, adjust settings, and review position data to optimize the leg elevation experience.

In other aspects, a current session button 708 allows physical therapists, healthcare professionals such as post-operative surgery assistants, or trainers to provide feedback, set targets, and monitor the user's progress in real-time. This current session button 708 acts as a central control for engaging with ongoing leg load management.

In many aspects, elevations data are displayed through engaged routine 710 and engaged routine 714:

Engaged routine 710 show detailed metrics of engaged relaxation routines and elevation routines, which are essentially sequences of various elevations, each elevation held for a certain amount of time. These are shown including elevation routine naming/numbering, the number of routines, percentages of maximum elevation utilized, durations, and repetitions, and may include essential identifiers such as location, date, time of the routines or even names of the user and/or prescribing therapist.

Scheduled routines (714) provide information about planned future sessions, enabling users to prepare and schedule their leg elevation activities effectively.

In certain aspects, a feedback popup 712 emerges upon the completion of an elevation routine. This popup 712 may offer the user options to save the activity data, repeat the routine, or close the notification, thereby enhancing user interaction and data management.

In some aspects, a view toggle button 716 allows users to switch between automatic and manual modes. In manual mode, routines are not automated through the controller, and the operation of the leg load distribution system is done manually by the user, utilizing the reverse ratcheting system or electric motor based on leg pressure through simple commands such as up, down, on, off, or release settings. The release setting may also be manually engaged by taking the fold angle of the pivoting joint beyond the maximum supported, which may be approximately, in one embodiment, around 20 degrees beyond a linear configuration.

In various aspects, controls including raise button 718 and lower button 720 may be digital buttons to interact through the screen or mechanical switches on the controller, including rotary and push-button types, to allow manual operation of the leg elevation mechanism. These switches may engage a ratcheting system that adjusts the elevation without electricity.

Raise button 718 in manual mode controls the elevation of the leg load distribution panel, allowing for manual adjustments to the leg's height.

Lower button 720 enables the user to decrease the elevation of the leg panel manually, tailoring the device to the user's comfort needs.

In several aspects, the current session button 708 displays the engaged tab 722 which includes a view button to show more details, and also is illustrated showing active routines, and the engaged tab 724 shows a timestamp and datestamp for one of the routines.

In other aspects, different embodiments of the user interface might include enhanced features such as voice command capabilities, providing hands-free operation capabilities. Integration with virtual reality (VR) or augmented reality (AR) systems for immersive therapy sessions and health monitoring sensors that may adjust the system based on physiological feedback from the user is also configurable via application programming interface customizations with the provided software application. Additionally, the software could employ artificial intelligence to learn from user interactions and automatically adjust settings for optimized comfort and effectiveness.

Figure 8:
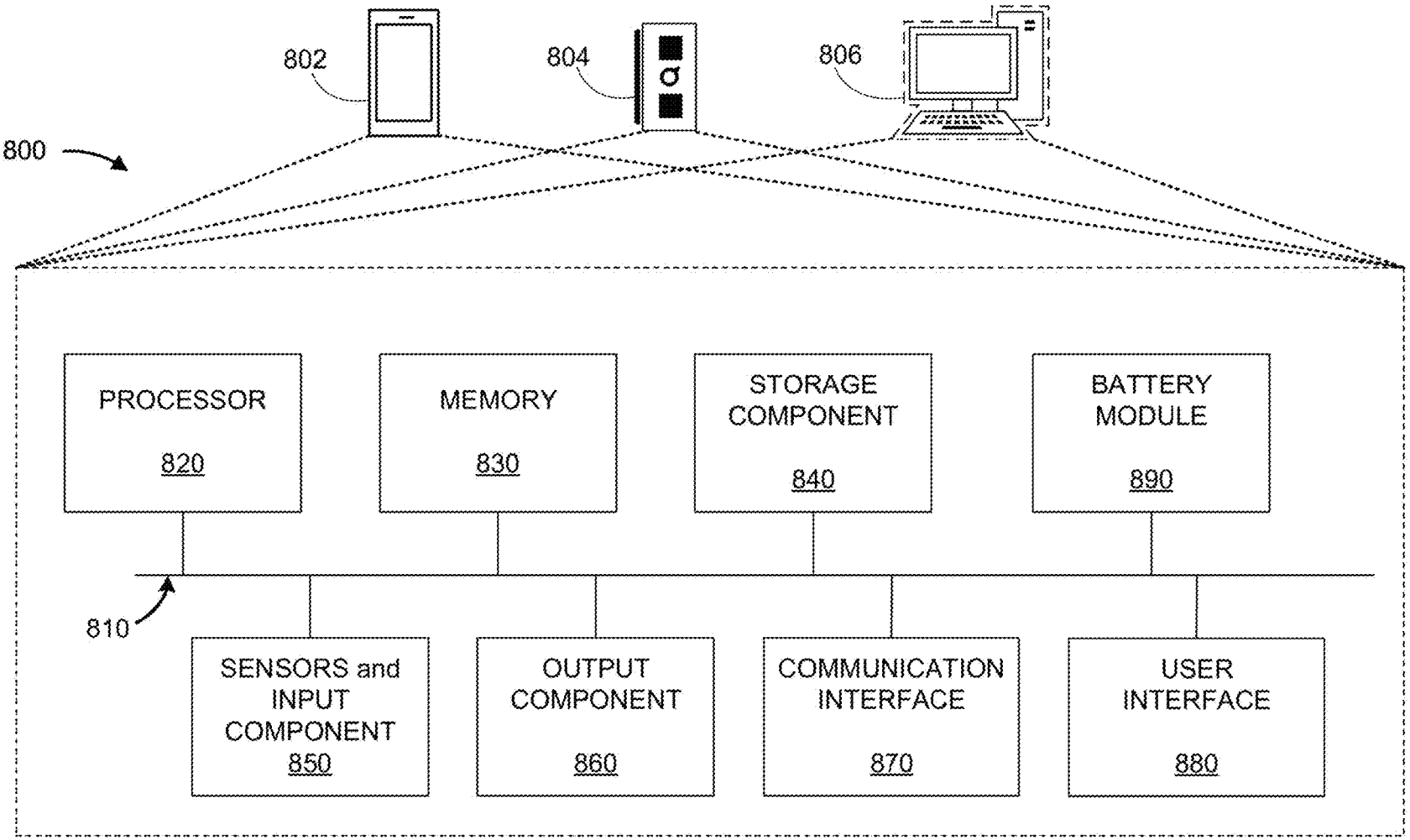
FIG. 8 illustrates internal subsystems in an example embodiment.

FIG. 8 illustrates an example data processing environment.

Various processes described herein may be implemented by appropriately programmed general purpose computers, special purpose computers, and computing devices. Typically, a processor (e.g., one or more microprocessors, one or more microcontrollers, one or more digital signal processors) will receive instructions (e.g., from a memory or like device), and execute those instructions, thereby performing one or more processes defined by those instructions. Instructions may be embodied in one or more computer programs, one or more scripts, or in other forms. The processing may be performed on one or more microprocessors, central processing units (CPUs), computing devices, microcontrollers, digital signal processors, or like devices or any combination thereof. Programs that implement the processing, and the data operated on, may be stored and transmitted using a variety of media. In some cases, hardwired circuitry or custom hardware may be used in place of, or in combination with, some or all of the software instructions that can implement the processes. Algorithms other than those described may be used.

Programs and data may be stored in various media appropriate to the purpose, or a combination of heterogeneous media that may be read and/or written by a computer, a processor or a like device. The media may include non-volatile media, volatile media, optical or magnetic media, dynamic random access memory (DRAM), static ram, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge or other memory technologies. Transmission media include coaxial cables, copper wire and fiber optics, including the wires that comprise a system bus coupled to the processor.

Databases may be implemented using database management systems or ad hoc memory organization schemes. Alternative database structures to those described may be readily employed. Databases may be stored locally or remotely from a device which accesses data in such a database.

In some cases, the processing may be performed in a network environment including a computer that is in communication (e.g., via a communications network) with one or more devices. The computer may communicate with the devices directly or indirectly, via any wired or wireless medium (e.g. the Internet, LAN, WAN or Ethernet, Token Ring, a telephone line, a cable line, a radio channel, an optical communications line, commercial on-line service providers, bulletin board systems, a satellite communications link, a combination of any of the above). Each of the devices may themselves comprise computers or other computing devices, such as those based on an Intel® or AMD® processor, that are adapted to communicate with the computer. Any number and type of devices may be in communication with the computer.

A server computer or centralized authority may or may not be necessary or desirable. In various cases, the network may or may not include a central authority device. Various processing functions may be performed on a central authority server, one of several distributed servers, or other distributed devices.

With reference to the figures and in particular, with reference to FIG. 8, these figures are example diagrams of data processing environments in which illustrative embodiments may be implemented. FIG. 8 is only an example and not intended to assert or imply any limitation with regard to the environments in which different embodiments may be implemented. A particular implementation may make many modifications to the depicted environments based on the following description.

FIG. 8 is a diagram of components of first user device 800, according to an example of the present disclosure. First user device 800 may include a bus 810, a processor 820, a memory 830, a storage component 840, an input component 850, an output component 860, a communication interface 870, and battery module 890.

Bus 810 includes a component that permits communication among the components of First user device 800. Processor 820 is implemented in hardware, firmware, or a combination of hardware and software. Processor 820 is a central processing unit (CPU), a graphics processing unit (GPU), an accelerated processing unit (APU), a microprocessor, a microcontroller, a digital signal processor (DSP), a field-programmable gate array (FPGA), an application-specific integrated circuit (ASIC), or another type of processing component. In some examples, processor 820 includes one or more processors capable of being programmed to perform a function. Memory 830 may include one or more memories such as a random access memory (RAM), a read only memory (ROM), and/or another type of dynamic or static storage device (e.g., a flash memory, a magnetic memory, and/or an optical memory) that stores information and/or instructions for use by processor 820. In some embodiments, a non-transitory computer-readable medium stores instructions that, when executed by a processor, cause the processor to perform various functions.

Storage component 840 stores information and/or software related to the operation and use of First user device 800. For example, storage component 840 may include a hard disk (e.g., a magnetic disk, an optical disk, a magneto-optic disk, and/or a solid state disk), a compact disc (CD), a digital versatile disc (DVD), a floppy disk, a cartridge, a magnetic tape, and/or another type of non-transitory computer-readable medium, along with a corresponding drive.

Input component 850 includes a component that permits first user device 800 to receive information, such as via user input (e.g., a touch screen display, a keyboard, a keypad, a mouse, a button, a switch, and/or a microphone). Additionally, or alternatively, input component 850 may include a sensor for sensing information (e.g., a GPS component, an accelerometer, a gyroscope, and/or an actuator). Output component 860 includes a component that provides output information from first user device 800 (e.g., a display, a speaker, a user interface, and/or one or more light-emitting diodes (LEDs)). Output component 860 may include a display providing a GUI, such as input configuration device 700. Input component 850 and output component 860 may be combined into a single component, such as a touch responsive display, also known as a touchscreen.

Communication interface 870 includes a transceiver-like component (e.g., a transceiver and/or a separate receiver and transmitter) that enables first user device 800 to communicate with other devices, such as via a wired connection, a wireless connection, or a combination of wired and wireless connections. Communication interface 870 may permit first user device 800 to receive information from another device and/or provide information to another device. Communication interface 870 may include one or more RFFEs (radio frequency front ends) with antennae circuitry and RF (radio frequency) filters which may be variable power and/or purpose adapted for various communication frequencies, standards, links, and distances. For example, communication interface 870 may include an Ethernet interface, an optical interface, a coaxial interface, an infrared interface, an RF interface, a universal serial bus (USB) interface, a Wi-Fi interface, a cellular network interface, or the like.

Battery module 890 is connected along bus 810 to supply power to processor 820, memory 830, and internal components of first user device 800. Battery module 890 may supply power during field measurements by first user device 800. Battery module 890 permits First user device 800 to be a portable integrated device for conducting field measurements of propagation delay in a RAN.

First user device 800 may perform one or more processes described herein. First user device 800 may perform these processes by processor 820 executing software instructions stored by a non-transitory computer-readable medium, such as memory 830 and/or storage component 840. A computer-readable medium is defined herein as a non-transitory memory device. A memory device includes memory space within a single physical storage device or memory space spread across multiple physical storage devices.

Sensors and input component 850 may include the transducers and/or piezoelectric microphones which may occupy instances of 840. They may also include finger swipe or pressure sensors, or magnetic hall effect-related sensors.

Software instructions may be read into memory 830 and/or storage component 840 from another computer-readable medium or from another device via communication interface 870. When executed, software instructions stored in memory 830 and/or storage component 840 may instruct processor 820 to perform one or more processes described herein. Additionally, or alternatively, hardwired circuitry may be used in place of or in combination with software instructions to perform one or more processes described herein. Thus, implementations described herein are not limited to any specific combination of hardware circuitry and software.

The number and arrangement of components shown in FIG. 8 are provided as an example. In practice, first user device 800 may include additional components, fewer components, different components, or differently arranged components than those shown in FIG. 8. Additionally, or alternatively, a set of components (e.g., one or more components) of first user device 800 may perform one or more functions described as being performed by another set of components of first user device 800.

This invention embodies a significant advancement in the adjustable seating and leg load distribution system domain, providing a solution that addresses both user comfort and versatile adaptability. Through its various embodiments, the invention remains adaptable to future material innovations and manufacturing technologies.

CONCLUSION

While a particular form of the invention has been illustrated and described, it will be apparent that various modifications can be made without departing from the spirit and scope of the invention. For example, various biodegradable materials may be substituted for each other. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A leg elevation device which is detached from any seatback, comprising:

a support structure configured to elevate a user's legs, the support structure comprising a first panel configured to rest on a seating surface and be sat on by a user, and a second panel pivotally connected to the first panel to receive a user's legs; and an adjustment mechanism integrated with the support structure for adjusting the elevation of the user's legs, wherein the adjustment mechanism comprises a pivot connection joint pivotally connecting the first panel and the second panel, the pivot connection joint comprising a ratchet hinge featuring a ratchet wheel and a pawl configured to lock the second panel in one of a plurality of discrete incremental elevation positions relative to the first panel.

2. The leg elevation device of claim 1, wherein the adjustment mechanism enables the support structure to collapse to a substantially planar configuration for convenient storage.

3. The leg elevation device of claim 2, adaptable for use with a variety of seating surfaces including office chairs, couches, and dining chairs.

4. The leg elevation device of claim 3, further comprising angle straps attached to the support structure for securing the leg elevation device at variable angles relative to a seating surface, accommodating various user preferences.

5. The leg elevation device of claim 1, wherein the adjustment mechanism comprises a pivoting mechanism including a reverse gear for facilitating incremental adjustments of an elevation of the support structure.

6. The leg elevation device of claim 5, further comprising a folding mechanism coupled to the support structure, which permits the device to alternate between an operational state and a collapsed state.

7. The leg elevation device of claim 6, wherein the pivoting mechanism is characterized by an incremental adjustment feature enabling sequential elevation adjustments of the support structure.

8. The leg elevation device of claim 7, wherein the support structure is fabricated from a material selected from the group consisting of microfiber, synthetic leather, and nylon to provide comfort and durability.

9. The leg elevation device of claim 7, structured to achieve at least five incremental elevation positions before reverting to a base position, ensuring a range of comfort options.

10. The leg elevation device of claim 9, wherein the support structure incorporates a reinforced frame designed to support a user weight of up to 250 pounds.

11. The leg elevation device of claim 10, wherein the pivoting mechanism comprises an elevation adjustment feature operable through motorized means for user ease.

12. The leg elevation device of claim 11, wherein the motorized elevation adjustment feature operates on a power source selected from a 120-volt transformer system or a rechargeable battery, ensuring versatile power options.

13. A method for elevating a user's legs, comprising:

providing a leg elevation device that includes a support structure and an adjustment mechanism, wherein the support structure comprises a first panel resting on a seating surface and sat on by a user, and a second panel pivotally connected to the first panel by a pivot connection joint comprising a ratchet hinge featuring a ratchet wheel and a pawl; and engaging the adjustment mechanism to modify the elevation of the support structure by pivoting the second panel relative to the first panel through the ratchet hinge to lock the second panel in one of a plurality of discrete incremental elevation positions, thereby elevating the user's legs.

14. The method of claim 13, wherein engaging the adjustment mechanism includes activating a pivoting mechanism fitted with a reverse gear, enhancing a user's control over leg elevation.

15. A leg elevation system for enhancing circulation in users' legs, comprising:

a leg elevation device featuring a support structure and an adjustment control system for modulating the elevation of the support structure, wherein the support structure comprises a first panel configured to rest on a seating surface and be sat on by a user, and a second panel pivotally connected to the first panel by a pivot connection joint comprising a ratchet hinge featuring a ratchet wheel and a pawl configured to lock the second panel in one of a plurality of discrete incremental elevation positions; and an interaction interface for receiving commands to adjust the elevation.

16. The leg elevation system of claim 15, wherein the adjustment control system includes a microcontroller, and the interaction interface is capable of receiving wireless signal or voice commands, offering hands-free operation.

17. The leg elevation system of claim 15, further comprising a software framework that enables remote configuration adjustments via a mobile application, adding a layer of convenience for users.

18. The leg elevation system of claim 15, further integrating health monitoring sensors for gathering data on user interaction, aiming for customized comfort adjustments.

19. The leg elevation system of claim 15, wherein the adjustment control system employs usage logs and a memory storage device to tailor elevation settings based on gathered usage data, optimizing user comfort and therapeutic benefit.

20. The leg elevation system of claim 15, designed for compatibility with virtual reality or augmented reality technologies, to provide guided therapeutic exercises, extending usability of the device beyond basic elevation.

* * * * *